US005414914A

United States Patent [19]

Suzuki et al.

[11] Patent Number: 5,414,914

[45] Date of Patent: May 16, 1995

[54] PROCESS FOR PRODUCING APERTURED NONWOVEN FABRIC

[75] Inventors: Migaku Suzuki, Kawanoe; Satoshi Nozaki, Ehime; Shigeo Imai, Kawanoe; Makoto Ishigami, Kawanoe; Toshio Kobayashi, Kawanoe, all of Japan

[73] Assignee: Uni-Charm Corporation, Ehime, Japan

[21] Appl. No.: 860,679

[22] Filed: Mar. 30, 1992

Related U.S. Application Data

[60] Division of Ser. No. 369,863, Jun. 22, 1989, which is a continuation of Ser. No. 280,447, Dec. 6, 1988, abandoned, which is a continuation of Ser. No. 128,196, Dec. 3, 1987, abandoned, which is a continuation of Ser. No. 907,967, Sep. 16, 1986, abandoned.

[30] Foreign Application Priority Data

Sep. 20, 1985 [JP] Japan ..... 60-208335
Sep. 20, 1985 [JP] Japan ..... 60-208336

[51] Int. Cl.[6] ..... D04H 13/00

[52] U.S. Cl. ..... 28/105; 492/30; 492/37; 156/168

[58] Field of Search ..... 28/105, 106; 29/171.1, 29/171.2, 171.3, 171.4, 171.5, 171.6, 171.7, 171.8; 72/186, 187, 196, 197; 602/76; 156/168

[56] References Cited

U.S. PATENT DOCUMENTS

| | | | |
|---|---|---|---|
| Re. 31,599 | 6/1984 | Rasen et al. | 156/168 X |
| 1,882,599 | 10/1932 | Hodshom | 28/104 X |
| 2,986,193 | 5/1961 | Howell | 29/121.1 X |
| 3,034,180 | 5/1962 | Greiner et al. | 28/106 x |
| 3,110,609 | 11/1963 | Bletzinger | 28/106 X |
| 3,218,381 | 11/1965 | Such et al. | 28/106 X |
| 3,350,260 | 10/1967 | Johnson | 28/106 X |
| 3,485,708 | 12/1969 | Ballou et al. | 28/105 X |
| 3,493,161 | 2/1970 | Billings et al. | 29/121.2 X |
| 3,527,668 | 9/1970 | Küsters et al. | 29/121.1 X |
| 3,873,255 | 3/1975 | Kalwaites | 425/83 |
| 4,083,090 | 4/1978 | Duvekot | 28/104 |
| 4,172,172 | 10/1979 | Suzuki | 428/224 |
| 4,190,695 | 2/1980 | Niederhauser | 428/234 |
| 4,503,696 | 3/1985 | Roeder | 72/197 |
| 4,741,941 | 5/1988 | Englebert et al. | 602/76 X |

FOREIGN PATENT DOCUMENTS

| | | | |
|---|---|---|---|
| 322878 | 7/1902 | France | 29/121.2 |
| 838718 | 4/1952 | Germany | 29/121.2 |
| 197607 | 7/1976 | Japan . | |

OTHER PUBLICATIONS

*Manual of Nonwovens*, Prof. Dr. Rado. Krvcma, Textile Trade Press 1971, pp. 15 and 16.

*Fabric Forming Systems*, Schwartz, Rhodes and Mohamed, Noyes Publications, 1982, p. 152.

*Primary Examiner*—John J. Calvert

*Attorney, Agent, or Firm*—Lowe, Price, LeBlanc & Becker

[57] ABSTRACT

An apparatus for producing apertured non-woven fabric which includes a cylindrical support having both a plurality of specially formed projections and a plurality of drainage holes in and around said projections.

6 Claims, 7 Drawing Sheets

PROCESS FOR PRODUCING APERTURED NONWOVEN FABRIC

This is a division of Ser. No. 369,863 filed on Jun. 22, 1989 which in turn is a continuation of application Ser. No. 280,447 filed Dec. 6, 1988, now abandoned, which in turn is a continuation of Ser. No. 128,196 filed on Dec. 3, 1987, now abandoned, which in turn is a continuation of Ser. No. 907,967 filed on Sep. 16, 1986, now abandoned, and the benefits of 35 USC 120 are claimed relative to this chain of applications.

BACKGROUND OF THE INVENTION

The present invention relates to a process for producing apertured nonwoven fabric.

Conventional techniques for producing apertured nonwoven fabric include the following:

(1) There has already been proposed a process in which fibrous web is placed on support meshes, and then high velocity water streams are jetted thereonto from above to distribute fibers aside and simultaneously to randomly entangle fibers with each other. At the same time, drainage is effected under suction from below said meshes. This process is disclosed, for example, in U.S. Pat. No. 3,485,706. According to this process of well known art, nackles of said meshes are utilized to form apertures in the fibrous web. However, the water streams jetted thereonto pass through said support meshes, so that it is impossible to use sufficiently the energy provided by the water streams for treatment of fiber entanglement. Certainly it is possible to form apertures in the fibrous web, but the efficiency of fiber entanglement is too low to achieve the desired strength of fiber entanglement. Furthermore, said nackles do not have a height sufficient to achieve the fiber distributing effect. As a consequence the apertures formed in the finished nonwoven fabric are unclearly contoured due to fibers remaining inside the apertures.

(2) There has already been well known a process in which the fibrous web is placed on the support meshes and a patterning plate having a plurality of holes corresponding to a pattern in which apertures are to be formed in the fibrous web is placed on the fibrous web, and then high velocity water streams are jetted from above onto the patterning plate to achieve the fiber distributing effect as well as fiber entangling treatment and simultaneously suction-drainage is effected from below said support meshes. This process is disclosed, for example, in U.S. Pat. Nos. 3,240,657 and 2,862,251. According to this process, the fibers lying below the zones of the patterning plate in which said holes are not present are free from influence of the water streams. The fibers lying below the respective holes of the patterning plate also can not obtain the desired strength of fiber entanglement, since, as in said process (1), the water streams pass through said support meshes and it is impossible to utilize sufficiently their energy for fiber entangling treatment. Moreover, the apertures formed in the finished nonwoven fabric are unclearly contoured due to fibers remaining therein.

(3) There has also already been proposed a process in which the fibrous web is placed on a patterning plate having the plurality of holes corresponding to a pattern in which apertures are to be formed in the fibrous web, and then high velocity water streams are jetted thereonto from above to achieve a fiber distributing effect as well as fiber entangling treatment and simultaneously suction-drainage is effected from below the patterning plate. This process is disclosed, for example, in Japanese Laid-Open Patent Aplication No. 52-59774. According to this process, the patterning plate includes planar zones having no holes and contributing to fiber entanglement. However, the apertures in the fibrous web are formed the that the fibers lying on the zones of the patterning plate in which said holes are not present are displaced under the action of the water streams into said holes in which no fiber entanglement is promoted. As a consequence, efficiency and strength of fiber entanglement are not satisfactory and the apertures formed in the finished nonwoven fabric are unclearly contured due to fibers remaining therein.

Furthermore, these three processes of the prior art require a high flow rate as well as a high jetting pressure of the water streams in order to obtain nonwoven fabric having the desired strength and relatively clear apertures. Such requirements disadvantageously increase a production cost.

An object of the present invention is to provide a process for producing apertured nonwoven fabric having clearly contoured apertures by distributing aside fibers lying on a plurality of projections regularly carried on support means towards surface portions defined between said projections.

Another object of the present invention is to provide a process for producing apertured nonwoven fabric having an excellent fiber rearrangement and the desired tensile strength by causing fiber entanglement at surface zones on which the water streams rebound and twice contribute to fiber entanglement, while effective drainage is achieved through a plurality of drainage holes regularly carried on said support means so that the efficiency of fiber entanglement may be improved at a low jetting pressure and a small flow rate of the water streams.

A further object of the present invention is to provide a process for producing apertured nonwoven fabric which can be carried out with an apparatus of compact construction by arranging the desired number of nozzle means around a cylindrical body of a desired diameter as a preferred embodiment of the support means.

Still other objects and advantages of the present invention will be apparent from the following description of preferred embodiments in conjunction with the accompanying drawings.

DESCRIPTION OF THE INVENTION

Figure 1:
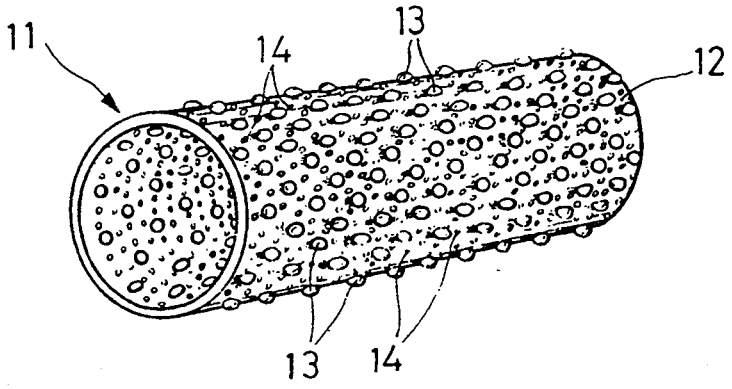
FIG. 1 is a perspective view showing a first embodiment of cylindrical support means.
Figure 2:
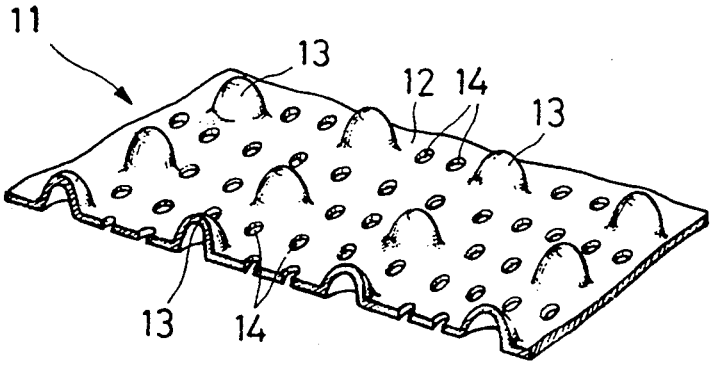
FIG. 2 is a fragmentary perspective view showing a part of the cylindrical support means as developed in an enlarged scale.
Figure 3:
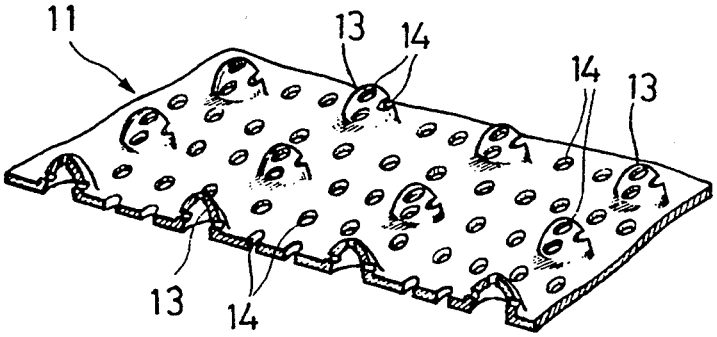
FIG. 3 is a view similar to FIG. 2 but showing a second embodiment of cylindrical support means.
Figure 4:
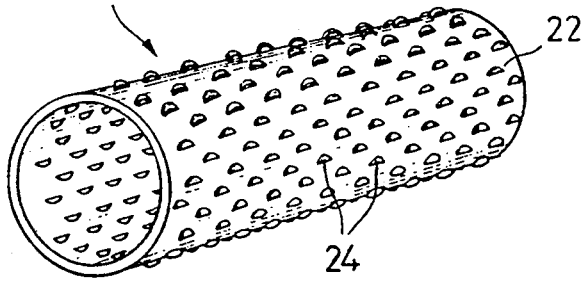
FIG. 4 is a view similar to FIG. 1 but showing a third embodiment of cylindrical support means.
Figure 5:
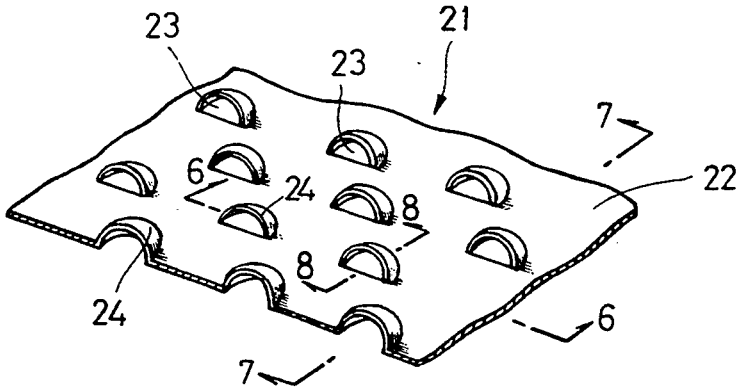
FIG. 5 is a view similar to FIGS. 2 and 3 but showing the third embodiment of cylindrical support means.
Figure 6:
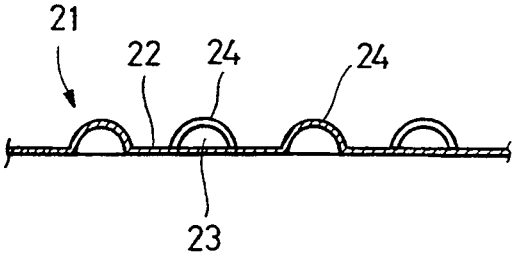
FIG. 6 is a sectional view taken along a line 6—6 in FIG. 5.
Figure 7:
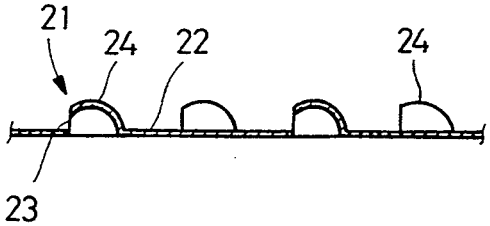
FIG. 7 is a sectional view taken along a line 7—7 in FIG. 5.
Figure 8:
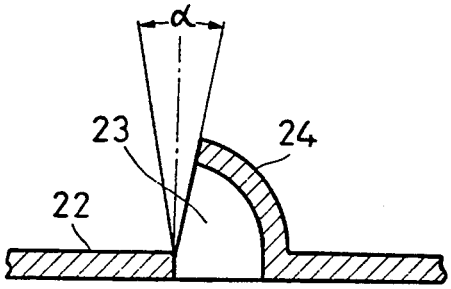
FIG. 8 is an enlarged sectional view taken along a line 8—8 in FIG. 5.

FIGS. 1 to 3 show support means 11 used in producing apertured nonwoven fabric by treating the fibrous web with jets of high velocity fine water streams so as to randomly entangle fibers with each other. The support means 11 is in the form of a cylindrical body 12 having the desired diameter and length, and consists of the body 12, a plurality of projections 13 carried at regular spacings on the smooth surface of the body 12 and a plurality of drainage holes 14 in the surface zones defined between the projections 13.

Preferably, each of the projections 13 is so shaped to be diverged from its apex gradually to its base, for example, in the form of a semi-sphere so that the efficiency for formation of apertures through the fibrous web may be improved and the nonwoven fabric thus formed may be easily peeled off from the support means 11 without any fiber rearrangement disturbance thereof. The projections 13 are hollow but may be unhollow.

To form clearly contoured apertures through the nonwoven fabric when the latter is completely produced, each of the projections 13 preferably has a diameter of 0.3 to 15 mm and a height of 0.4 to 10 mm.

Preferably, the projections 13 are formed at a pitch of 1 to 15 mm. With a pitch smaller than 1 mm, the respective apertures would be continuous from one to another in the finished nonwoven fabric and with a pitch larger than 15 mm spacing among the respective apertures would be too large in the finished nonwoven fabric.

The embodiment as shown in FIG. 2 in which the drainage holes 14 are formed in the surface zones defined between the projections 13 is optimal. However, the drainage holes 14 may be formed also in the projections 13 themselves, as in the embodiment of FIG. 3.

Preferably, each of the drainage holes 14 has a diameter of 0.1 to 2.0 mm and these are preferably formed at a pitch of 0.4 to 3.5 mm. The total area of the drainage holes 14 preferably occupies 2 to 35% of the effective area of the support means 11 as a whole.

With a diameter smaller than 0.1 mm, the drainage holes 14 would often be clogged with impurities or the like included in the fibrous web or the water streams and, as a result, the effect of suction drainage by suction means would be reduced. With a diameter larger than 2.0 mm, on the other hand, fibers of the fibrous web would cohere into or pass through the drainage holes 14 under the jetting pressure of the water streams and, as a result, the fiber rearrangement of the fibrous web was disadvantageously disturbed and improvement of fiber entanglement could not be expected.

FIGS. 4 through 8 show still another embodiment of the support means 21. This support means 21 is in the form of a cylindrical body 22 having the desired diameter and length, and consists of the body 22, a plurality of projections 24 carried at regular spacings on the smooth surface of the body 22 and drainage holes 23 formed in one side of each of the projections 24.

Preferably, each of the projections 24 is shaped to be diverged from its apex gradually to its base, for example, in the form of a dome so that the efficiency for formation of apertures through the fibrous web may be improved and the nonwoven fabric after formation may be easily peeled off from the support means 21.

The drainage holes 23 formed in one side of each of the projections 24 themselves must open at such an angle with respect to the plane of the smooth surface that the fibrous web is not forced into these drainage holes 23 when the water streams are jetted from above onto the fibrous web placed on the support means 21. The optimal angle at which these drainage holes 23 open is substantially normal (90°) but may be 75° to 105° ($\alpha$) in practice.

Other requirements of the drainage holes 23 and the projections 24 are the same as those of the drainage holes 14 and the projections 13.

The support means 11 or 21 may be made of metallic plate such as a stainless-steel plate having a hardness sufficient to cause rebounding streams when the water streams strike it, since said rebounding streams also can contribute to promote the fiber entanglement. The projections 13 or 24 may be formed by stamping of said metallic plate. However, the projections 13 may be formed by electrodeposits on the said metallic plate so that they need not be hollow. Although the cylindrical support means as illustrated is optimal, said support means may be an endless belt or a curved plate, as desired.

It is obvious that the projections 13 or 24 may be formed in any pattern corresponding to the pattern of the nonwoven fabric in which the apertures are to be formed so long as the above-mentioned requirements are met and the pattern of dotting is not limited to the embodiments as shown.

Figure 9:
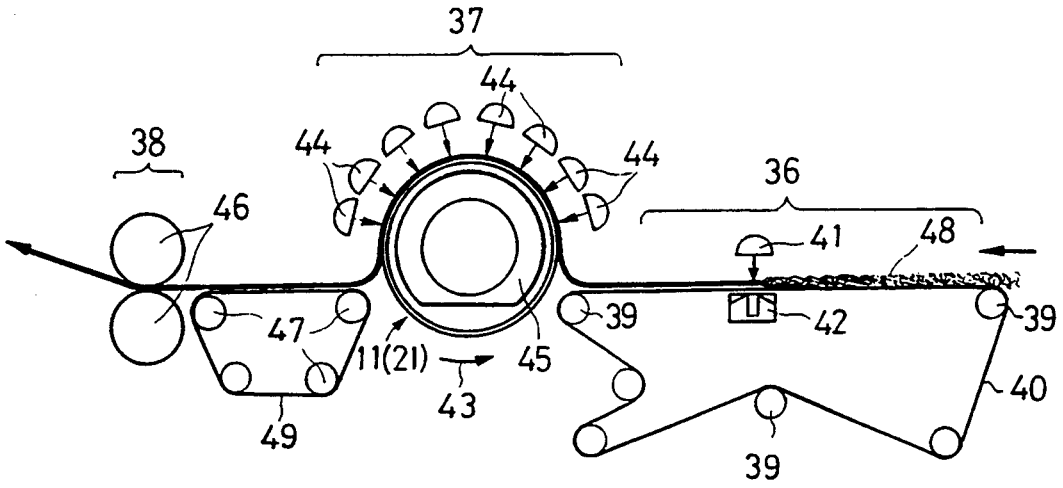
FIG. 9 is a schematic diagram showing a part of nonwoven fabric producing apparatus including the cylindrical support means and suction means arranged in the interior of said support means.

FIG. 9 shows support means 11 or 21 as being incorporated in the apparatus for producing the nonwoven fabric. As such apparatus, it is preferred to employ the apparatus as disclosed by the applicant of the present invention in GB Pat. No. 2114173 and EP Patent application No. 84300001.9. Details are described in these patents and, therefore, explanation of the apparatus and the fibrous web to be treated will not be repeated here. The apparatus comprises a pretreatment station 36, a principal treatment station 37 and a moisture squeezing station 38. The pretreatment station 36 is supported by a group of rollers 39 and comprises a water-permeable belt 40 made of meshes having no function of forming the apertures in the finished nonwoven fabric, nozzle means 41 disposed above the belt 40 to jet high velocity fine water streams, and suction means 42 disposed under the belt. The principal treatment station 37 comprises the cylindrical support means 11 or 21 adapted to rotate in a direction as indicated by an arrow 43, several nozzle means 44 arranged at predetermined intervals, and suction means 45 disposed inside the cylindrical support means. Both the projections 13 and the drainage holes 14 provided for the support means 11 have no particular orientation but holes 23 and 24 provided for the support means 21 have such an orientation that the drainage holes 23 open in a direction opposite to that in which the fibrous web 48 travels (i.e., leftwards as seen in FIG. 9) The moisture squeezing station 38 comprises a pair of press rollers 46. The orifices in each of the nozzle means have preferably a diameter of 0.05 to 0.2 mm and a pitch of 0.5 to 3 mm, and the pitch should be shorter than that of the projections 13 or 24.

The fibrous web 48 formed, for example, in a card is introduced onto the belt 40 on which the fibrous web 48 is subjected to a preliminary fiber entangling treatment by high velocity fine water streams jetted through orifices of the respective nozzle means 41 from above, and then the water streams which have completed their action upon the fibrous web are drained by the suction means 42. The fibrous web 48 having its fibers entangled together to a certain degree in this step of pretreatment is then introduced onto the support means 11 or 21 on which the fibrous web 48 is subjected to the final treatment of fiber entanglement and simultaneous formation of apertures by the water streams jetted through orifices of the respective nozzle means 44, and then the water streams which have completed their action upon the fibrous web are drained by suction means 45. The nonwoven fabric in which the desired apertures and fiber entanglement have been formed by the final treatment is transferred by a transfer belt 49 supported by a group of rollers 47 to a pair of squeezing rollers 46 between which the moisture content of said nonwoven fabric is removed, and further transferred to the following steps such as those of drying and taking-up. It should be understood here that, although said web immediately after formation is so loose and fluffy that the fibers thereof are puffed out or dispersed under the jetting pressure of the water streams such fibrous web would not be suitable to form the apertures in the fibrous web 48. The formation of apertures can more stably and more efficiently be carried out at said principal treatment station, since the fibrous web 48 is subjected to said preliminary fiber entangling treatment as mentioned above.

As material for the fibrous web 48, every kind of fiber conventionally used for nonwoven fabrics may be employed in the form of a random web, a parallel web or a cross web, and their basic weight is prefably 15 to 100 $g/m^2$.

The jetting pressure of the water streams is preferably 5 to 100 $Kg/cm^2$, and particulary 40 to 90 $Kg/cm^2$. At a pressure lower than 5 $Kg/cm^2$, an energy sufficient to cause the fiber entanglement could not be obtained, resulting in unsatisfactory effect both for the fiber entanglement and the formation of apertures, even when the amount of water is increased. At a pressure higher than 100 $Kg/cm^2$, on the other hand, the cost would increase to a level which is commercially disadvantageous. A water delivery is preferably 1 to 20 $l/m^2$. At a water delivery lower than 1 $l/m^2$, the result would be poor with respect to both the fiber entanglement and the formation of apertures as concerning the jetting pressure of the water streams. The water delivery depends on the jetting pressure, the number of the orifices and the diameter of each orifice. However, even when the water delivery is higher than 20 $l/m^2$, both the fiber entanglement and the formation of apertures are not proportionally improved, so such effort would be economically disadvantageous.

The water streams jetted from above onto the fibrous web 48 distribute aside fibers lying on the projections 13 or 24 towards the surface zones defined among the projections 13 or 24 to form apertures in the fibrous web 48 and simultaneously cause the fibers thus forcibly distributed aside towards said surface zones to be entangled together. The water streams having completed their action upon the fibers are drained by the suction means 45 through the drainage holes 14 or 23. The fibers on said surface zones can sufficiently entangle together and strongly cohere by the action of the water streams and their rebounding streams when the water streams jetted from above strike said fibers and said surface zones. It should be noted here that the fibers lying on said surface zones do not cohere into or pass through the drainage holes 14 or 23 under the jetting pressure of the water streams. Therefore, the efficiency achieved by the support means according to the present invention is substantially higher than that achieved by the conventional support means made of meshes.

Thus, the present invention permits the formation of apertures to be clearly contoured and the fiber entanglement to be sufficiently achieved even under water streams of relatively low pressure and thereby makes it possible to produce the apertured nonwoven fabric of good fiber rearrangement and desired strength at a low cost. Such apertured nonwoven fabrics are suitable to utilize as material for absorbent articles, clothing and ornaments, etc.

EXAMPLE 1

Figure 10:
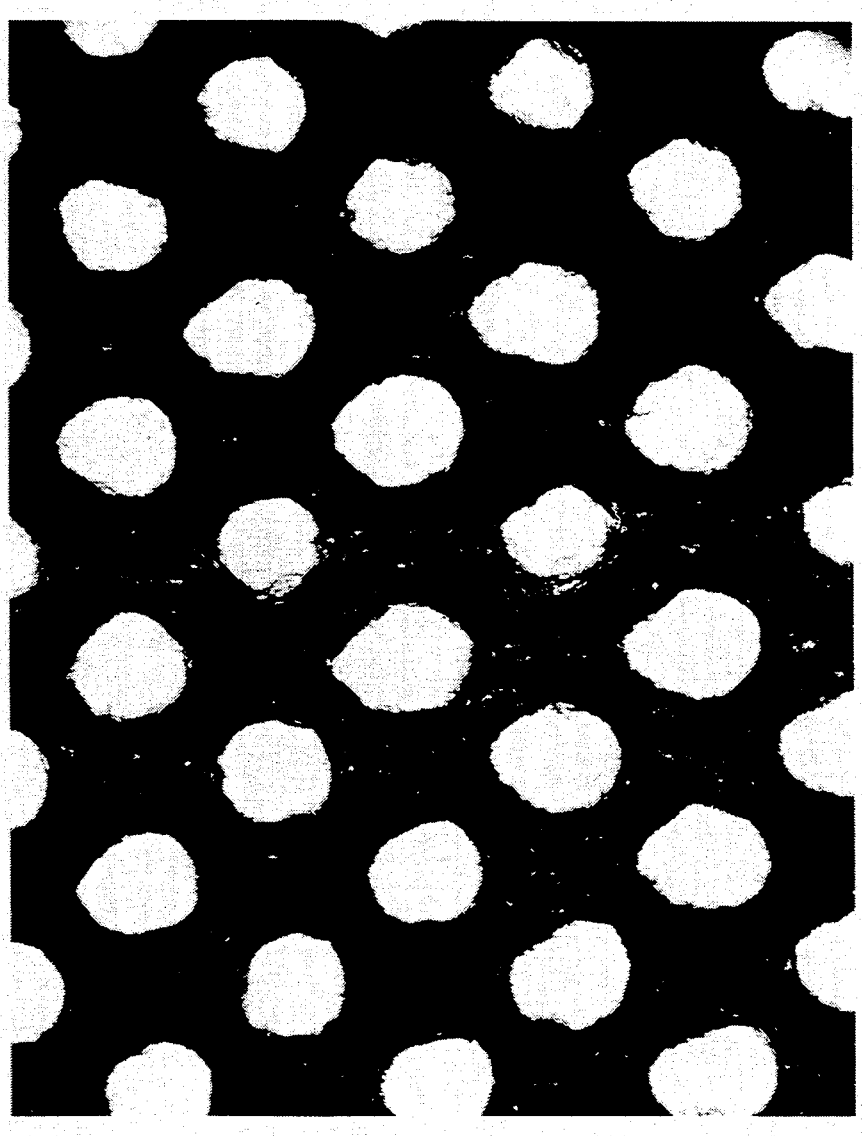
FIG. 10 is a photographic illustration showing apertured nonwoven fabric produced using the first embodiment of cylindrical support means as viewed from above as magnified 5 times.

Using the apparatus as shown by FIG. 9, a 100% polyester fibrous web with a basic weight of 30 $g/m^2$ was treated with columnar water streams at a jetting pressure of 70 $Kg/cm^2$ and a water delivery of 9.5 $l/m^2$ to form apertured nonwoven fabric as shown in FIG. 10. The fibrous web was 3 m wide and passed at a speed of 70 m/min under water streams at 2000 l/min. Nozzle means were utilized having orifices, each 130$\mu$ in diameter, arranged at a pitch of 1 mm.

As the support means, a seamless cylinder 500 mm in diameter manufactured by the nickel-electro-forming method was employed, which carries a plurality of substantially semi-spherical projections, each having a diameter of 2 mm and the height of 0.8 mm, regularly formed on a surface of said cylinder so as to occupy 35% of the surface area and, a plurality of drainage holes, each 0.4 mm in diameter, were formed through the cylinder in the surface zones defined between said projections so as to be regularly presented and occupy 9% of the surface area of said cylinder.

EXAMPLE 2

Figure 11:
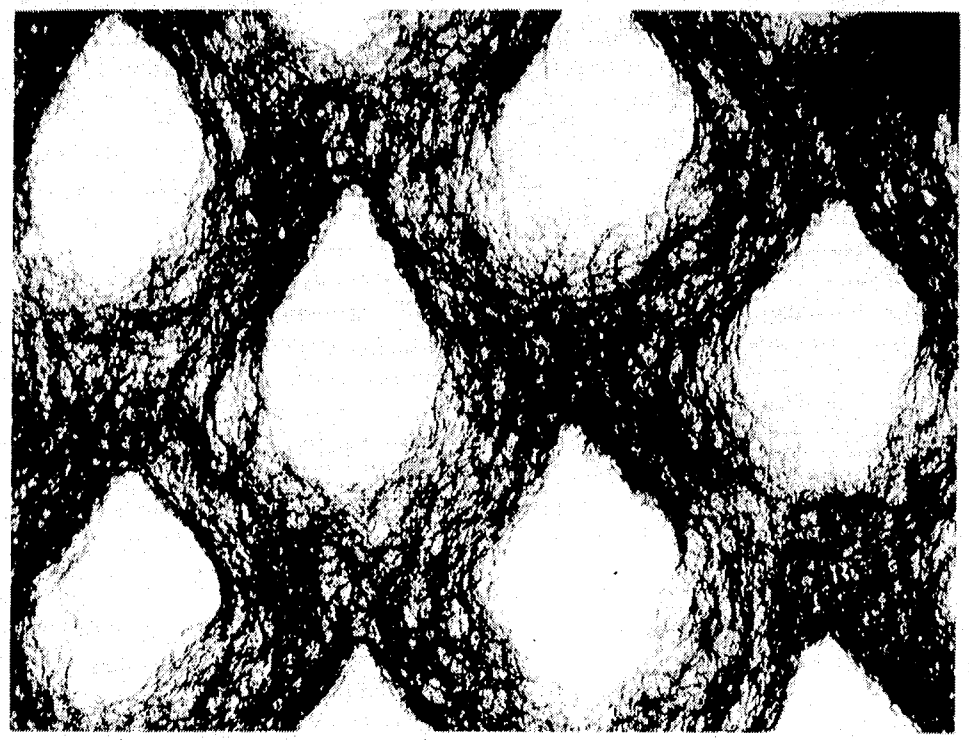
FIG. 11 is a photographic illustration showing apertured nonwoven fabric produced using the third embodiment of cylindrical support means as viewed from above as magnified 5 times.

Using the apparatus as shown by FIG. 9, a 100% polyester fibrous web with a basic weight of 30 $g/m^2$ was treated with columnar water streams at a jetting pressure of 70 $Kg/cm^2$ and a flow rate of 9.5 $l/m^2$ as said fibrous web was fed at a velocity of 70 m/min to form apertured nonwoven fabric as shown in FIG. 11. Nozzle means were utilized having orifices, each 130$\mu$ in diameter, arranged at a pitch of 1 mm.

The support means utilized possessed the following specifications:

Material: stainless plate

Area ratio of projections (total area of projections/effective total area of support means): 17.5%

Area ratio of drainage holes (total area of drainage holes/effective total area of support means): 3.67%

Figure 12:
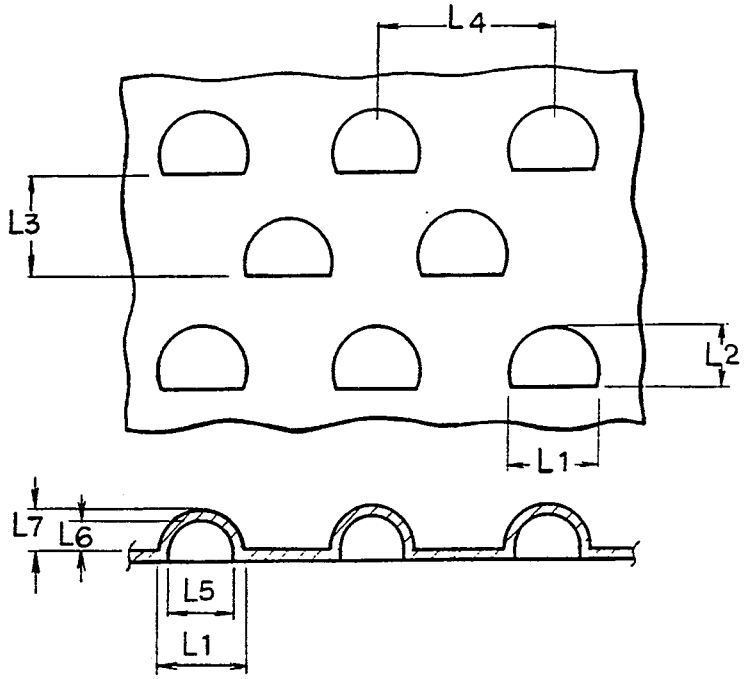
FIG. 12 is a diagram indicating dimensions of various parts of the third embodiment of cylindrical support means used in Example 2.

Dimensions in FIG. 12

$L_1$: 5 mm, $L_2$: 2.86 mm, $L_3$: 5.45 mm, $L_4$: 10 mm, $L_5$: 3.04 mm, $L_6$: 0.99 mm, $L_7$: 1.58 mm.

Control 1

Figure 13:
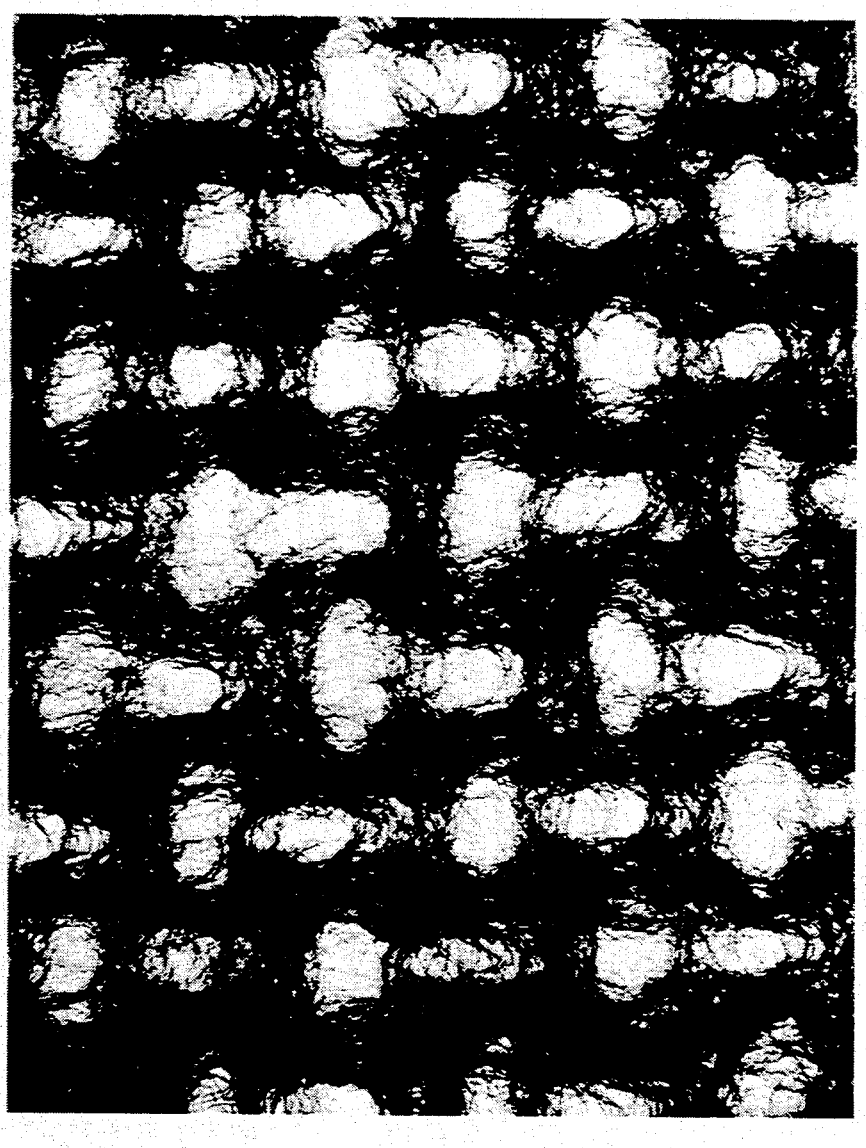
FIGS. 13 and 14 are photographic illustrations showing apertured nonwoven fabrics of Controls 1 and 2, respectively, as viewed from above as magnified 5 times.

Treatment was carried out under similar condition as in Examples 1 and 2 except that the cylindrical support means used in Examples 1 and 2 was replaced by an endless belt of plain woven 10 mesh fabric to form apertured nonwoven fabric as shown in FIG. 13.

Control 2

Figure 14:
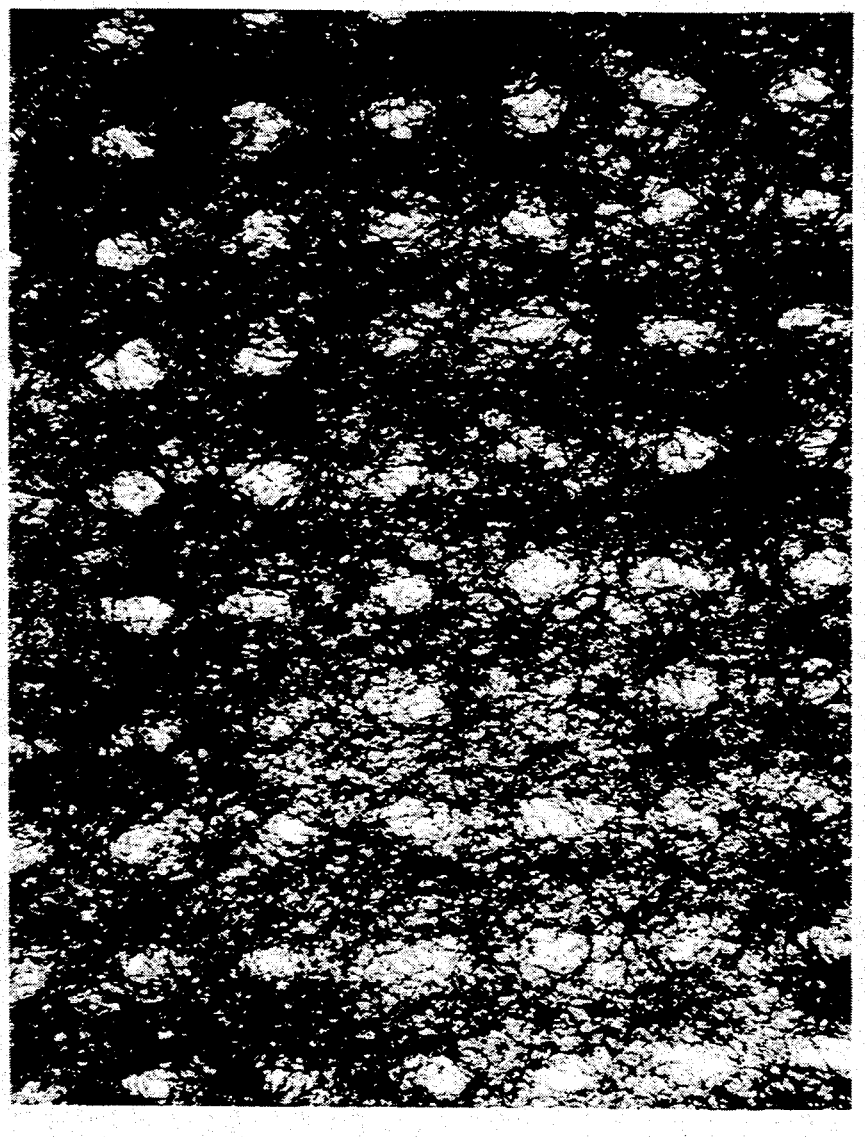

The cylindrical support means used in Examples 1 and 2 was replaced by an endless belt of 76 mesh satin. A seamless cylinder 380 mm in diameter manufactured according to the nickel-electro-forming technique and carrying a plurality of drainage holes each 2 mm in diameter regularly formed in its peripheral wall was disposed around said endless belt leaving a space through which fibrous web could travel. Water streams in the form of curtain were jetted from inside of said meshes at a jetting pressure of 15 Kg/cm$^2$ and a flow rate of 30 l/m$^2$ onto the fibrous web, being fed at a velocity of 10 m/min. The rest of the treatment was preformed under the same conditions as in Examples 1 and 2 and apertured nonwoven fabric as shown in FIG. 14 was obtained.

The apertured nonwoven fabrics obtained in the above-mentioned Examples 1, 2 and Controls 1, 2 exhibited performances as set forth in the following table.

| | basic weight (g/m$^2$) | thick-ness (mm) | tensile strength (g/5 cm wide) MD | CD | state of apertures (see FIGS. 10, 11) 13, 14) |
|---|---|---|---|---|---|
| Example 1 | 29.8 | 0.48 | 11019 | 2242 | clear |
| Example 2 | 30.0 | 0.598 | 9900 | 2500 | clear |
| Control 1 | 30.2 | 0.50 | 6604 | 862 | unclear |
| Control 2 | 29.3 | 0.77 | 73 | 10 | unclear |

As will be apparent from this table, the tensile strength of MD/CD of Examples 1 and 2 is remarkably improved with respect to that of Controls 1 and 2.

Having described specific embodiments of our invention, it is believed that obvious modifications and variations of the present invention is possible in light of the above teachings.

What is claimed is:

1. A one-part support means for producing non-woven fabric having round patterned apertures which comprises a hollow cylindrical body having a continuous smooth surface formed by the known method of nickel-electro-forming and as a unitary part thereof a plurality of spaced apart upwardly converging rounded protuberances extending upwardly in an uninterrupted continuous manner from the smooth surface of said cylindrical body, said rounded protuberances being formed at a pitch of 1–15 mm and shaped at the base portions thereof in a round pattern substantially corresponding to the round pattern of the aperture shapes that are to be formed in the non-woven fabric, said support means also having a plurality of drainage holes having diameters of 0.1 to 1.0 mm and defining a total open area of 2 to 35% of said body.

2. A support means as set forth in claim 1 wherein each of said rounded protuberances is shaped to diverge gradually from a rounded apex portion that has a small area to its base portion which has a larger area.

3. A support as set forth in claim 1 wherein each of said rounded protuberances has a diameter of 0.3 to 15 mm and a height of 0.4 to 10 mm.

4. A support as set forth in claim 1 wherein said drainage holes are formed in the surface zones located between said rounded protuberances.

5. A support according to claim 1 wherein said drainage holes have a pitch of 0.5 to 3.5 mm and each of said drainage holes has a diameter of 0.2 to 2.0 mm.

6. A support according to claim 1 wherein said drainage holes are also formed in the said rounded protuberances.

* * * * *